US005697222A

United States Patent [19]

Lee

[11] Patent Number: 5,697,222

[45] Date of Patent: Dec. 16, 1997

[54] METHODS AND APPARATUS FOR DETERMINING WHEN A WATER RESERVOIR IN A REFRIGERATOR NEEDS REFILLING

[75] Inventor: Kun Bin Lee, Seoul, Rep. of Korea

[73] Assignee: Samsung Electronics Co., Ltd., Suwon, Rep. of Korea

[21] Appl. No.: 735,700

[22] Filed: Oct. 23, 1996

[30] Foreign Application Priority Data

Oct. 31, 1995 [KR] Rep. of Korea ..... 95-38840
Oct. 15, 1996 [KR] Rep. of Korea ..... 96-46100

[51] Int. Cl.[6] ..... F25C 1/00

[52] U.S. Cl. ..... 62/66; 62/233; 62/340; 137/552.7; 417/63

[58] Field of Search ..... 62/66, 233, 340; 137/386, 552.7; 417/63

[56] References Cited

U.S. PATENT DOCUMENTS 5,331,994 7/1994 Bryan, III et al. ..... 137/1
5,363,093 11/1994 Williams et al. ..... 340/605

*Primary Examiner*—William E. Tapolcai
*Attorney, Agent, or Firm*—Burns, Doane, Swecker & Mathis, L.L.P.

[57] ABSTRACT

An ice making tray in a refrigerator is connected by a pump to a water reservoir located in the refrigerator. Once ice has been ejected from the tray and into a bin, the pump is activated for a preset period to re-fill the ice tray with water from the reservoir. Each time that the pump is activated, its time period of operation is automatically counted, and a running total of the counted time periods is automatically kept. That total is compared to a predetermined (reference) value representing a period of pump operation which causes the water in the tank to be reduced to a predetermined low level. When the running total reaches the reference value, an alarm is energized to warn a user that the reservoir should be re-filled.

5 Claims, 4 Drawing Sheets

METHODS AND APPARATUS FOR DETERMINING WHEN A WATER RESERVOIR IN A REFRIGERATOR NEEDS REFILLING

BACKGROUND OF THE INVENTION

The present invention relates to a water supply apparatus and a water level deficiency detection method for a refrigerator, and more particularly to a water supply apparatus and a water level deficiency detection method for a refrigerator in which water is supplied to a water consumption site such as an automatic ice maker and a water dispenser by means of a water supply pump.

A refrigerator provided with an automatic ice maker for automatically making ice and a water dispenser installed in the front surface of the refrigerator door for providing the ice maker with cold water is widely used. The water is automatically supplied to both the automatic ice maker and the water dispenser from a water supply apparatus including a water reservoir tank and a water supply pump both of which are provided in the refrigerator. Since it is difficult to sufficiently increase the capacity of the water reservoir tank due to spatial limitation in the cooling room of the refrigerator, water needs to be supplemented relatively often into the water reservoir tank.

If a user does not supplement water into the water reservoir tank of the water supply apparatus in time, the water reservoir tank will lack water. Then since the water supply apparatus cannot provide water to the automatic ice maker and the water dispenser in time, a user cannot obtain a desired amount of ice or cold water for drinking in time.

In a conventional water supply apparatus for a refrigerator as shown in FIG. 1, a controller 30 receives a signal from a floater switch 31 which is turned on or off by a floater which is installed in the water reservoir tank and goes up and down according to a level of the water in the water reservoir tank, and activates a light-emitting diode (LED) 32 for warning a user of a water deficiency when the water reservoir tank lacks water. That is, the floater switch 31 maintains a turn-off state when the floater is in a raised state due to the presence of sufficient water in the water reservoir tank, and is turned on if the floater goes down below a limit level due to the presence of insufficient water in the water reservoir tank. The controller 30 recognizes the water shortage in the water reservoir tank based on the turn-on signal of the floater switch 31 and activates the alarm LED 32.

However, since the above method for detecting water level deficiency in the water reservoir tank requires a floater which is activated in the water reservoir tank and a floater switch which is turned on or off by the floater, the number of the components and the production cost is increased.

Meanwhile, U.S. Pat. No. 4,909,039 to Yamada et al., discloses a method for detecting a water demanding condition of an ice maker. Here, as shown in the flowchart of FIG. 2, after a water supply operation is completed (S1–S4), a predetermined time elapses (S5 and S6) whereupon, the temperature of an ice tray in the automatic ice maker is sensed (S7). When the sensed temperature is below a predetermined temperature, it is determined that sufficient water has not been delivered to the ice tray (S8). Then, the LED for warning a user of the water level deficiency in the water reservoir tank is activated (S13). When the sensed temperature exceeds a predetermined temperature, it is determined that sufficient water has been delivered to the ice tray (S9), and then an ice making and removal operation is executed (S10–S12). That is, the U.S. Pat. No. 4,909,039 method determines that sufficient water has not been placed in the ice tray if the temperature of the ice tray does not exceed the predetermined temperature after a predetermined time elapses from completion of the water supply operation, to accordingly inform a user of the water deficiency in the water reservoir tank.

However, the U.S. Pat. No. 4,909,039 method checks whether the water reservoir tank lacks the water based on the state that the water has not been supplied to an automatic ice maker and indicates the result. Thus, such an alarm is only an ex post facto measure. Thus, although the water reservoir tank lacks sufficient water, a user may not be aware of such a deficiency of the water reservoir tank until a predetermined time elapses after the next ice making and removal operation cycle has passed and the water supply operation has been completed.

SUMMARY OF THE INVENTION

To solve the above problem, it is an object of the present invention to provide a water supply apparatus and a water level deficiency detection method for a water reservoir tank of a refrigerator, which efficiently detects the water deficiency in the water reservoir tank and of the water deficiency in time.

To accomplish the above object of the present invention, there is provided a water level deficiency detection method for a water reservoir tank in a water supply apparatus of the refrigerator for supplying water from the water reservoir tank to a water consumption site by means of a water supply pump, the water level deficiency detection method comprising the steps of:

counting every operation time of the water supply pump;

accumulating the counted pump operation time;

comparing the accumulated pump operation time with a predetermined pump use limit time; and determining that the water reservoir tank lacks sufficient water when the accumulated pump operation time exceeds the pump use limit time as a result of the comparison.

The water supply pump of the water supply apparatus has a constant water supply capacity per time. Thus, the operation time of the water supply pump is proportional to an water supply amount. Therefore, the capacity of the water reservoir tank can be converted into a limit operation time of the water supply pump. When an accumulated operation time of the water supply pump exceeds the limit operation time, it may be determined that the water reservoir tank lacks the water. When it is determined that the water reservoir tank lacks the water, it is preferable that an alarm operation is executed.

According to another aspect of the present invention, there is provided a water supply apparatus for a refrigerator, comprising:

a water reservoir tank containing water;

a water supply pump for supplying the water to a predetermined water consumption site from the water reservoir tank;

a timer for counting every operation time of the water supply pump;

a time accumulator for accumulating the pump operation time counted by the timer; and a water level deficiency determiner for comparing the accumulated pump operation time with a predetermined pump use limit time and for determining that the water reservoir tank lacks sufficient water when the accumulated pump operation time exceeds the pump use limit time.

Here, the water supply apparatus may further comprise an alarm means for warning a user of the water level deficiency when the water level deficiency determiner determines that the water level is deficient. It is preferable that the alarm means is a light-emitting diode.

DETAILED DESCRIPTION OF THE PREFERRED EMBODIMENT

A preferred embodiment of the present invention will be described below in more detail with reference to the accompanying drawings.

Figure 1:
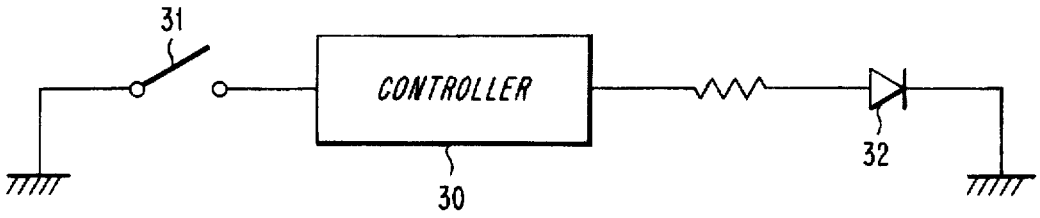
FIG. 1 (PRIOR ART)
FIG. 1 is a view of a conventional water level deficiency detection device for a water reservoir tank.
Figure 3:
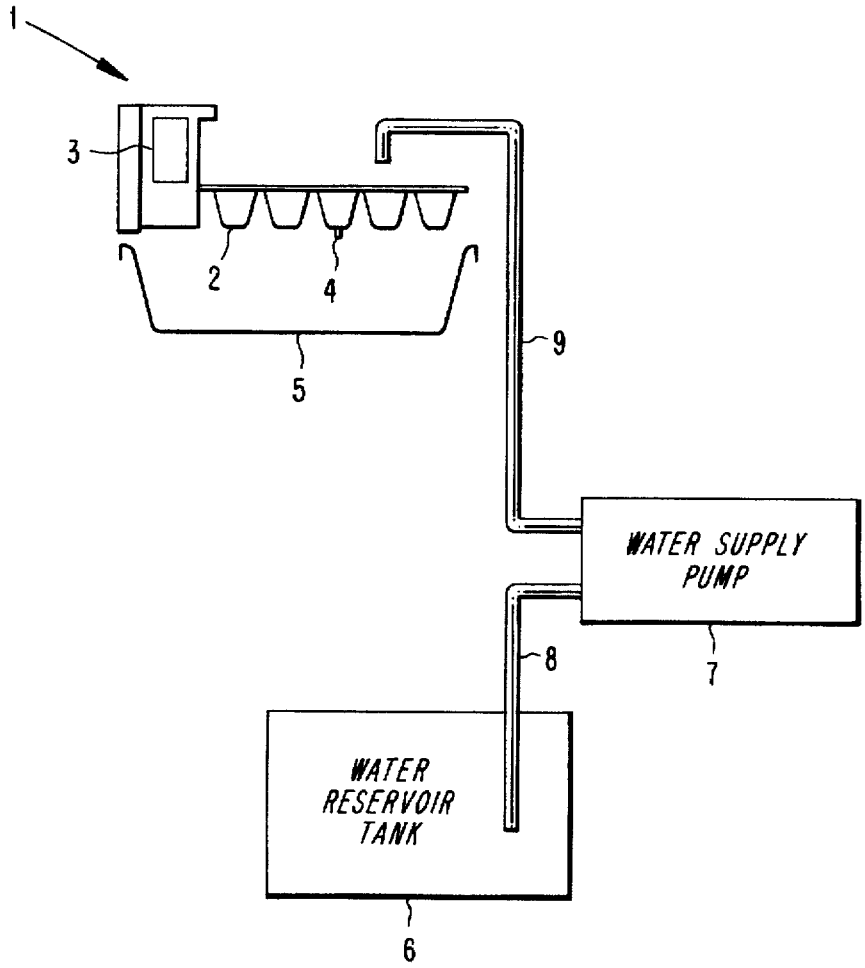
FIG. 3 is a schematic view showing a water supply apparatus according to the present invention.
Figure 2:
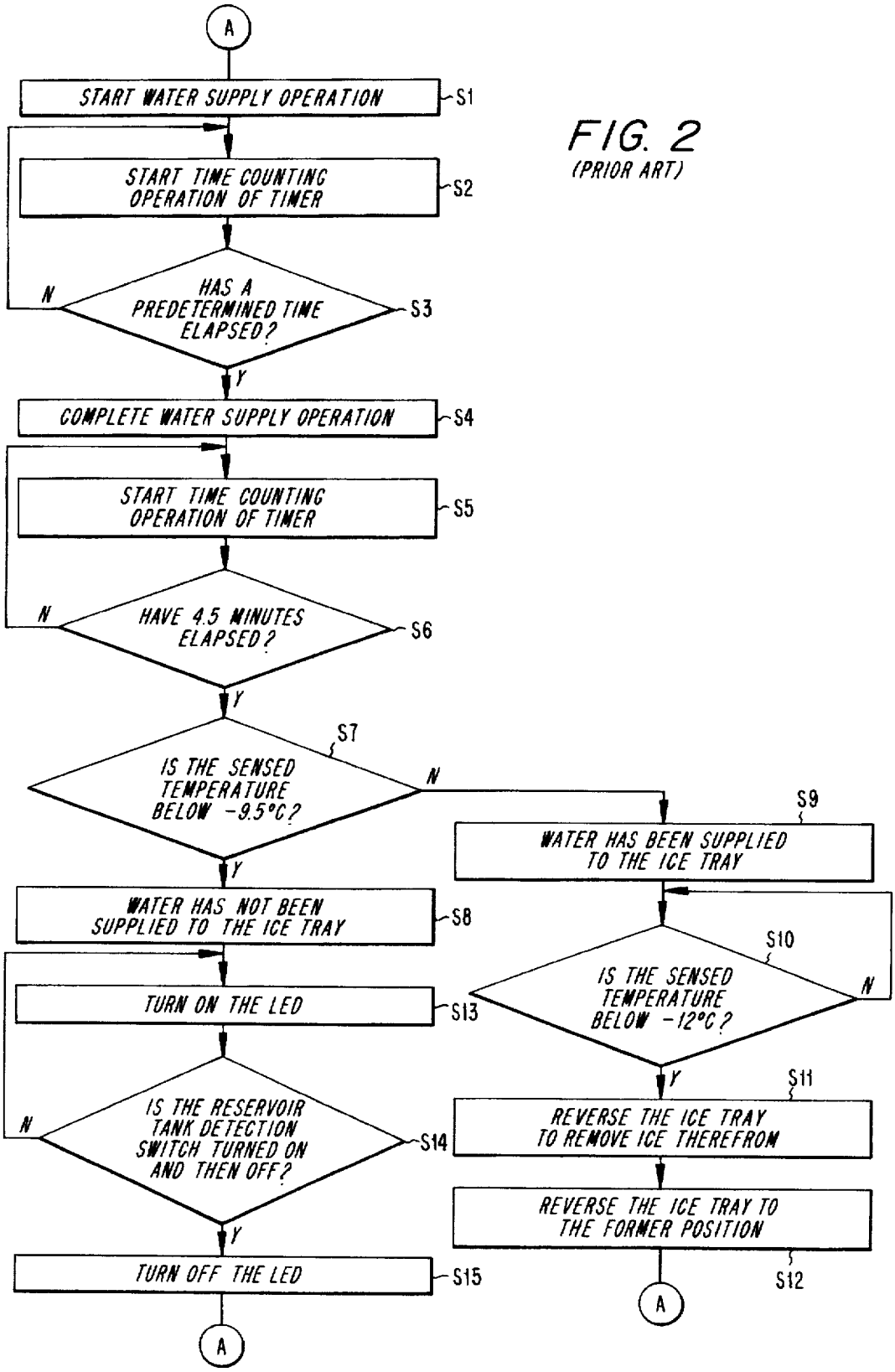
FIG. 2 (PRIOR ART)
FIG. 2 is a flowchart diagram showing another conventional water level deficiency detection method for a water reservoir tank.

In FIG. 3 showing a water supply apparatus according to the present invention, an example for supplying water to an ice tray of an automatic ice maker by a water supply apparatus is shown. An automatic ice maker 1 includes an ice tray 2, and an ice removal motor 3 for rotating the ice tray 2 via a shaft in the positive and negative directions. An ice removal temperature sensor 4 for detecting the temperature of the ice tray 2 to determine the ice removal time is attached under the ice tray 2. An ice vessel for receiving and storing the removed ice from the ice tray 2 is provided beneath the ice tray 2.

The water supply apparatus for supplying the water to the automatic ice maker 1 includes a water reservoir tank 6 containing the water and a water supply pump 7 for sucking up the water via a sucking pipe 8 from the water reservoir tank 6. The water supply pump 7 supplies the water to the ice tray 2 via a water supply pipe 9.

Figure 4:
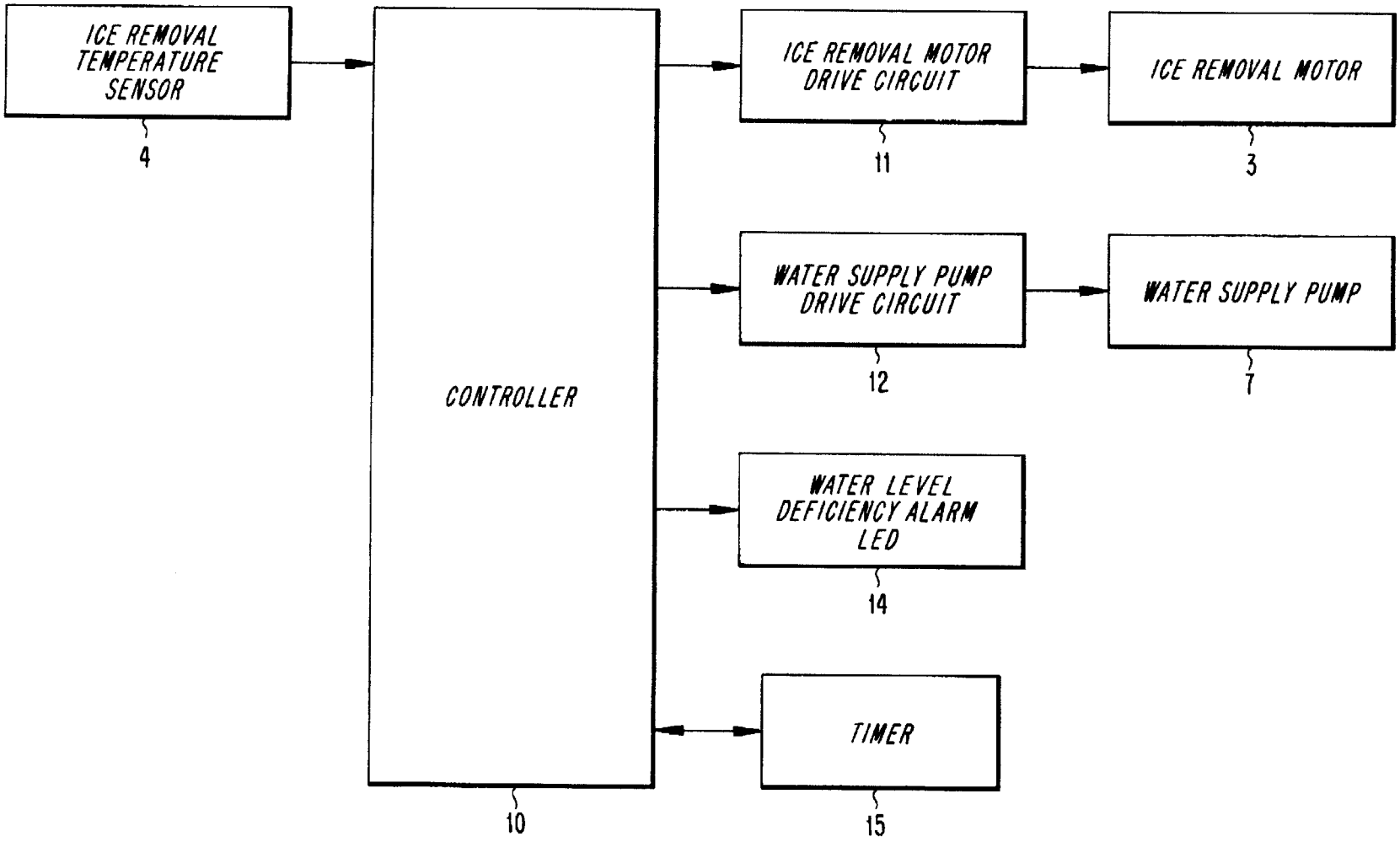
FIG. 4 is block diagram for explaining a control operation of a water supply apparatus according to the present invention.

FIG. 4 is a block diagram for explaining a control operation of a water supply apparatus according to the present invention. A controller 10 usually comprised of a microcomputer receives signals from the ice removal temperature sensor 4 of the automatic ice maker and from a timer 15 and outputs control signals to an ice removal motor drive circuit 11, a water supply pump drive circuit 12 and a water level deficiency alarm light-emitting diode (LED) 14. The ice removal motor drive circuit 11 and the water supply pump drive circuit 12 are controlled by the controller 10 to drive an ice removal motor 3 and a water supply pump 7, respectively.

The controller 10 determines that it is an ice removal time when the temperature is below a predetermined temperature based on a temperature signal supplied from the ice removal temperature sensor 4 in the automatic ice maker 1, and outputs a command signal for activating the ice removal motor 3 to the ice removal motor drive circuit 11. Accordingly, the ice removal motor is activated to invert the ice tray 2, and the ice removed from the ice tray is contained in the ice vessel 5. When the ice removal operation is completed, the ice tray 2 is returned to the former uptight position by the ice removal motor 3. When the ice tray 2 is returned to the former position, the controller 10 provides a control signal for driving the water supply pump 7 to the water supply pump drive circuit 12, to activate the water supply pump 7. The water supply pump 7 operates for a time corresponding to the capacity of the ice tray 2 and is deactivated under the control of the controller 10.

In response to the start of the water supply pump 7, the controller 10 starts the timer 15 and counts the operation time of the water supply pump 7. The counted operation time of the water supply pump for repeated tray fillings is accumulated by an operation time accumulator provided in the controller 10. When the total accumulated pump operation time exceeds a predetermined pump use limit time corresponding to a capacity of the water reservoir, a water level deficiency determiner in the controller 10 determines that the water reservoir tank must lack water. Here, the pump use limit time is obtained by dividing the maximum capacity of the water reservoir tank 6 into a water supply amount per unit time of the water supply pump 7. For example, assuming that the maximum capacity of the water reservoir tank 6 is two liters and the water supply capability of the water supply pump 7 is one liter per minute, the pump use limit time becomes two minutes. If the water level deficiency determines that the pump has operated for a total time of two minutes, i.e., that the water reservoir tank lacks water, the controller 10 activates the water level deficiency alarm LED 14 to warn a user of the water deficiency.

Figure 5:
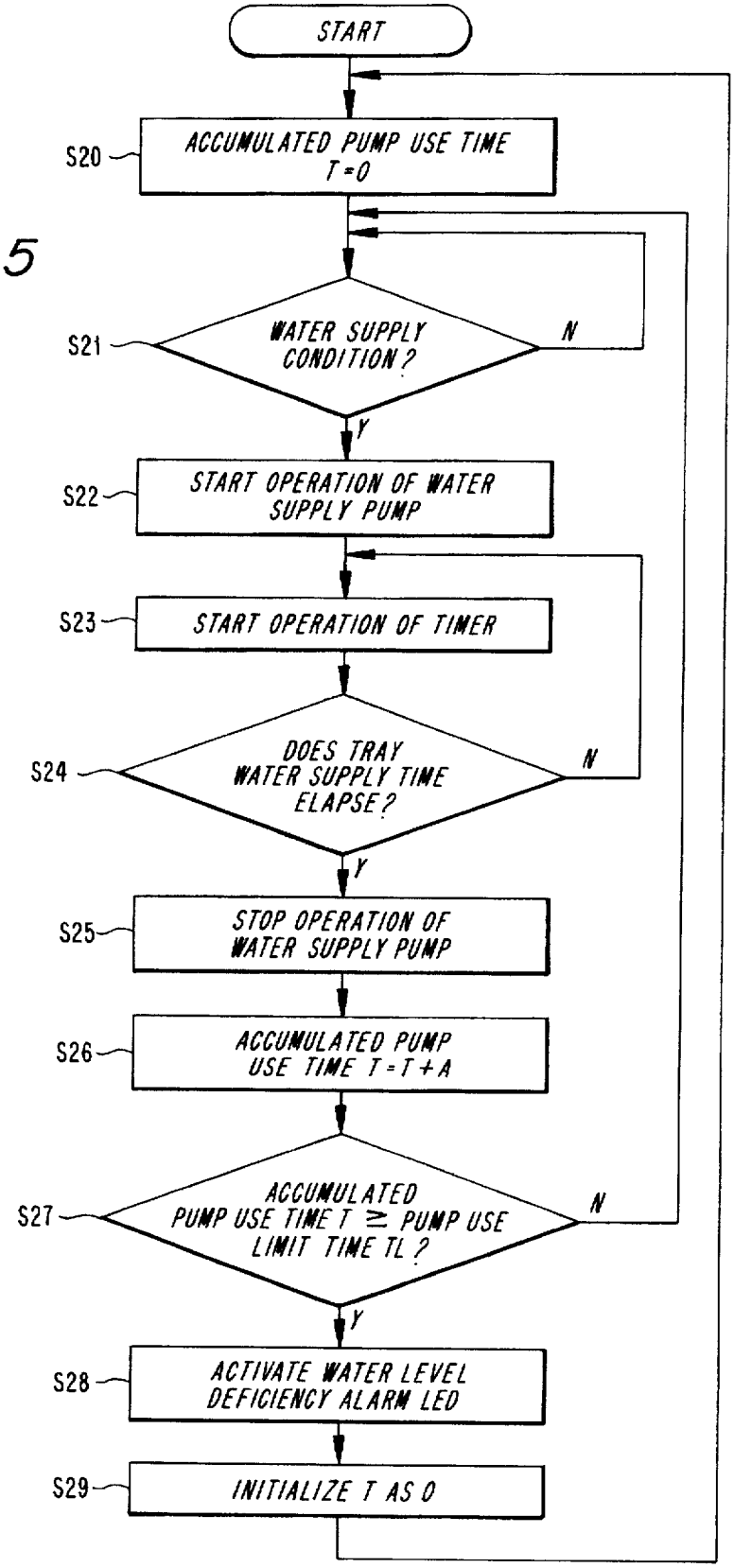
FIG. 5 is a flowchart diagram showing a water level deficiency detection method for a water reservoir tank according to the present invention.

The water level deficiency determination process in the controller 10 is shown in the flowchart of FIG. 5. An accumulated pump use time T is initialized as 0 (S20). If a water supply condition occurs (S21), the controller 10 starts to activate the water supply pump 7 (S22). The water supply condition of the automatic ice maker occurs when an ice removal operation is completed and the ice tray 2 is returned to the former upright position. Upon the start of the water supply pump 7, the controller 10 activates the timer 15 to count the operation time of the water supply pump 7 (S23). Since the ice tray 2 has a predetermined capacity, a water supply amount can be controlled by a corresponding operation time of the water supply pump. When a tray water supply time A necessary for filling the ice tray 2 with water elapses (S24), the operation of the water supply pump 7 is stopped (S25). The tray water supply time A is added to the accumulated pump operation time T which has been accumulated during previous tray-filling operations to obtain a new accumulated pump use time T (S26), and compares the new accumulated pump use time with the pump use limit time TL (S27). The pump use limit time TL represents the capacity of the water reservoir tank 6 as a function of the operation time of the water supply pump 7.

If it is determined that the accumulated pump use time T does not exceed the pump use limit time TL in step S27 then, it is determined that a sufficient amount of water is present in the water reservoir tank 6 and waits for occurrence of the following water supply condition. If it is determined that the accumulated pump use time T exceeds the pump use limit time TL in step S27 then, it is determined that an insufficient amount of water in the water reservoir tank 6 remains. Accordingly, the controller 10 activates the water level deficiency alarm LED 14 (S28) and initializes the accumulated pump use time T as "0" (S29). When the water level deficiency alarm LED is activated in step S28, the user recognizes the water level deficiency and the need to add water into the water reservoir tank.

The above described and illustrated embodiment describes a case when the water supply apparatus supplies the water to only the automatic ice maker. However, it is apparent to one skilled in the art that the present invention can be applied to cases that water is supplied to a water dispenser and an automatic ice maker alone or in combination.

As described above, the present invention determines whether or not a water reservoir tank lacks water by accumulating the operation time of a water supply pump. Thus, present invention can efficiently detect the water deficiency in the water reservoir tank and does not require an additional component such as a floater.

What is claimed is:

1. A method for detecting the presence of an insufficient amount of water in a water reservoir located in a refrigerator, water being periodically dispensed from the reservoir by the activation of a pump, the method comprising the steps of:

A) predetermining a pump operation time period which reduces the water in the reservoir to a predetermined level;

B) counting the pump operation time period every time that the pump is operated;

C) accumulating the pump operation time periods counted in step B; and

D) comparing the accumulated pump operation time periods to step C with the predetermined pump operation time period of step A and emitting a signal when the accumulated pump operation time periods of step C reaches the predetermined pump operation time period of step A.

2. The method according to claim 1, further including the step of supplying the signal of step D to an indicator which warns a user of a water deficiency in the water reservoir.

3. A water supply apparatus for use in a refrigerator, comprising:

a water reservoir;

a pump connected to the water reservoir for periodically pumping water therefrom;

a counter connected to the pump for counting a pump operation time period every time that the pump is operated;

an accumulator connected to the counter for accumulating the pump operation time periods counted by the counter; and a comparitor connected to the accumulator for comparing the accumulated pump operation time periods with a predetermined pump operation time period which reduces a water level in the reservoir to a predetermined value, and emitting a signal when the accumulated pump operation time periods reach the predetermined pump operation time period.

4. The apparatus according to claim 3, further comprising an indicator connected to the comparitor for being activated by the signal to warn a user of a water deficiency in the water reservoir.

5. The apparatus according to claim 4, wherein the indicator is a light-emitting diode.

* * * * *